US007851420B2

(12) United States Patent
Theunissen et al.

(10) Patent No.: US 7,851,420 B2
(45) Date of Patent: Dec. 14, 2010

(54) CORROSION PROTECTION AGENT FOR FUNCTIONAL FLUIDS WATER-MISCIBLE CONCENTRATE AND USE THEREOF

(75) Inventors: Helmut Theunissen, Westerstede (DE); Sabine Theunissen, Berlin (DE)

(73) Assignee: Helmut Theunissen, Westerstede (DE)

( * ) Notice: Subject to any disclaimer, the term of this patent is extended or adjusted under 35 U.S.C. 154(b) by 153 days.

(21) Appl. No.: 11/665,160

(22) PCT Filed: Oct. 17, 2005

(86) PCT No.: PCT/EP2005/011149

§ 371 (c)(1),
(2), (4) Date: Apr. 12, 2007

(87) PCT Pub. No.: WO2006/042730

PCT Pub. Date: Apr. 27, 2006

(65) Prior Publication Data

US 2007/0298983 A1 Dec. 27, 2007

(30) Foreign Application Priority Data

Oct. 19, 2004 (EP) ..... 04024857

(51) Int. Cl.
*C10M 173/00* (2006.01)
*C10M 141/06* (2006.01)

(52) U.S. Cl. ..... 508/555; 508/551; 508/583; 508/525; 508/526; 508/506; 72/42

(58) Field of Classification Search ..... 508/264, 508/267, 443, 555, 583, 459, 539, 506, 553, 508/489, 551, 525, 526; 252/392, 396; 44/385
See application file for complete search history.

(56) References Cited

U.S. PATENT DOCUMENTS 3,833,565 A * 9/1974 Curry ..... 546/6
3,985,504 A * 10/1976 Kindscher et al. ..... 422/13
4,331,545 A * 5/1982 Papay et al. ..... 508/194
4,391,722 A * 7/1983 Schwartz et al. ..... 252/73
4,729,769 A * 3/1988 Schlicht et al. ..... 44/418
5,132,046 A * 7/1992 Edebo et al. ..... 508/156
5,389,199 A * 2/1995 Awad et al. ..... 508/150
5,668,084 A * 9/1997 Unhoch et al. ..... 504/158
2002/0088167 A1* 7/2002 Filippini et al. ..... 44/301
2003/0045605 A1* 3/2003 Thompson ..... 523/130
2004/0154217 A1* 8/2004 Watanabe et al. ..... 44/385

FOREIGN PATENT DOCUMENTS

EP 0 591 771 4/1994
EP 1 174 489 1/2002

OTHER PUBLICATIONS

Industrial Surfactants, 2nd Ed. by Ernest W. Flick; Noyes PUblicaitons, Copyright 1993; pp. 106-112 and160-168.*

* cited by examiner

*Primary Examiner*—Ellen M McAvoy
*Assistant Examiner*—Pamela Weiss
(74) *Attorney, Agent, or Firm*—The Nath Law Group; Joshua B. Goldberg; Tanya E. Harkins

(57) ABSTRACT

A corrosion protection agent for functional fluids is disclosed, comprising 5 to 80 wt. % of at least one fatty acid alkanolamide, based on saturated or unsaturated fatty acids with 10 to 20 carbon atoms, 5 to 80 wt. % of at least one alcohol with 2 to 14 carbon atoms and 5 to 80 wt. % of at least one aromatic moncarboxylic acid or an aliphatic dicarboxylic acid with 10 to 12 carbon atoms, whereby the sum of said components amounts to 100 wt. % and the wt. % is based on the weight of the corrosion protection agent, a water-miscible concentrate, containing said corrosion protection agent, for functional fluids based on water and use thereof for the production of lubricants, abrasive agents, hydraulic fluids and cooling lubricants for metal working and metal cutting.

28 Claims, No Drawings

CORROSION PROTECTION AGENT FOR FUNCTIONAL FLUIDS WATER-MISCIBLE CONCENTRATE AND USE THEREOF

The present invention comprises a corrosion protectant for functional liquids, a water-soluble concentrate containing this corrosion protectant for aqueous functional liquids, and its use.

Due to their low flammability and low environmental risk, aqueous functional liquids are receiving increased attention. These functional liquids are liquids that are used as lubricants, abrasives, coolant and lubricant for metal forming and metal cutting, and especially as pressure fluids, namely hydraulic fluids as well. These aqueous functional liquids are also known as HFA liquids or HFA hydraulic fluids. Such HFA hydraulic fluids are used especially in hydraulic face extraction systems in mines. They are made on site by mixing from 1 to 20 weight % of an aqueous concentrate containing one of the necessary effective ingredients with the associated 99 to 80 weight % of water. The concentrates can contain, as lubricants, synthetic products or products based on mineral oil. Depending on the composition of the water-soluble concentrate, HFA hydraulic fluid is either an emulsion (HFAE), including a micro-emulsion, with mineral or synthetic oil, or solutions (HFAS). Such HFA hydraulic liquids have the viscosity of water, and can be used in a temperate range of +5° C. to +55° C.

When this type of aqueous functional liquid, or HFA hydraulic liquid, does not provide sufficient corrosion protection, then this leads to corrosion of the surfaces that are in contact with the functional liquid, namely the hydraulic system. In particular, it can cause pitting, cavities, crater formation, and even precipitation of scale-forming corrosion products. Since this type of corrosion must be avoided at all costs when HFA hydraulic liquid is used in large hydraulic systems, such as in face support in mining, these aqueous functional liquids contain corrosion protectants and other additives, such as animal, vegetable, mineral, and/or synthetic oils, fats, or oil or fat components as lubricants, fatty alcohols, biocides, fungicides, complexing agents, heavy metal inhibitors, nonionic or anionic emulsifiers, dispersing agents, and antifoaming agents.

From EP 1 175 489 A1 we know of a method for the manufacture of aqueous cutting fluids that contain and oil phase, an aqueous phase, a bactericide or fungicide, and high-pressure components. These cutting fluids can contain organic acids, such as sebacic acid.

From DE 198 33 894 A1 we know of a water-soluble coolant-lubricant concentrate that contains natural or synthetic mineral oils, emulsifiers, dissolving agents, preservatives, metal inhibitors, and other typical additives, and has a pH of less than 7.7 to ensure cutaneous tolerance. As a corrosion protectant, this concentrate can contain reaction products of boric acid, with primary or tertiary alkanolamines, ethoxylated or propoxlated fatty acids or fatty acid alkanolamides, phosphoric acid esters, triazoles or thiadiazole, either alone or in combination. Although this document states that an aqueous coolant/lubricant can be made with this concentrate that has a pH value close to neutral, and that nevertheless does not lead to rusting of metal parts that are treated with an aqueous solution of the coolant/lubricant, these concentrates and the functional liquids made from them do not have satisfactory corrosion effects. In particular, these aqueous coolant/lubricants lead to corrosion of exposed metal surfaces when they are in contact with metal surfaces for a long period of time, such as is the case in hydraulic systems, namely through pitting and precipitation of undesired scale.

The object of the present invention is thus to present a corrosion protectant for functional fluids in which the corrosion protection behaviour of such HFA fluids, namely of HFA hydraulic fluids for hydraulic systems, is improved without reducing performance to other requirement of such a fluid, such that it can be used in large-volume, extremely expensive hydraulic systems, such as are using in mining.

Surprisingly, it was discovered that a combination of at least three different corrosion protection additives, each known in itself, the corrosion protection behaviour of such HFA hydraulic fluids is improved to an unexpectedly great degree, so that not only pitting, cavities, and crater formation are prevented, but also the precipitation of scale-forming corrosion products can be completely avoided, which can be observed using typical HFA fluids in the gap corrosion test per DSK Norm N 762 830, described below.

The object of the invention is thus the corrosion protectant per the primary claim. The subclaims refer to preferred embodiments of this object of the invention, a water-soluble concentrate containing this corrosion protectant, and its use for manufacturing aqueous lubricant, abrasive, hydraulic fluid, or coolant/lubricant for use in metal forming and cutting.

An embodiment of the invention is thus a corrosion protectant for functional fluids that contains 5 to 80 weight % of at least a fatty acid alkanolamide based on saturated or unsaturated fatty acids with 10 to 20 carbon atoms, 5 to 80 weight % of at least one alcohol with 2 to 14 carbon atoms, and 5 to 80 weight % of at least one aromatic monocarboxylic acid or an aliphatic dicarboxylic acid with 10 to 12 carbon atoms, where the sum of these components is 100 weight %, and the weight percent is relative to the weight of the corrosion protectant.

Comparative experiments, which are explained in the following examples and comparative examples, have shown that only when the corrosion protectant contains the three indicated required components, and the aromatic monocarboxylic acid or aliphatic dicarboxylic acid has a total of 10 to 12 carbon atoms, including the carboxyl groups, can the undesired corrosion be completely avoided. For example, in the presence of an aliphatic monocarboxylic acid with 10 carbon atoms, such as neodecanoic acid, the occurrence of solid precipitates and line corrosion cannot be avoided. This result is doubtless surprising and unexpected from the perspective of a person skilled in the art.

Preferably, the corrosion protectant in accordance with the invention contains 25 to 60 weight % of the at least one fatty acid alkanolamide, 15 to 25 weight % of the at least one alcohol, with 20 to 50 weight % of the at least one aromatic monocarboxylic acid or aliphatic dicarboxylic acid of the type defined above.

The fatty acid alkanolamides in the corrosion protectant according to the invention are preferably based on saturated or unsaturated fatty acids with 12 to 18 carbon atoms, and alkanolamines with 2 to 6 carbon atoms, namely monoethanolamine, diethanolamine, triethanolamine, monopropanolamine, monoisopropanolamine, 2-amino-2-methyl-1-propanol, 2-amino-2-ethyl-1,3-propandiol, and/or diglycolamine, which is also known as 2-aminoethoxyethanol or ethylene glycol-2-aminoethylether.

Especially preferred fatty acid alkanolamides according to the invention are coconut acid alkanolamides and tall oil acid monoalkanolamides, such as coconut acid monoethanolamide, coconut acid monopropanolamide, and especially reaction products from coconut acid, coconut oil, tall oil acid, and/or tall oil and diglycolamine.

The corrosion protectant according to the invention contains a second necessary component, an aliphatic, aromatic, or aliphatic-aromatic mono or dialcohol, with preferably 8 to 10 carbon atoms, and especially preferably isopropanol, n-butanol, butyldiglycol, hexylene glycol, butyltriglycol, benzyl alcohol, and/or phenoxyethanol.

The aromatic monocarboxylic acid or aliphatic dicarboxylic acid used as the third significant component of the corrosion protectant according to the invention is preferably selected from the group containing sebacic acid, undecanedioic acid, dodecanedioic acid, and p-tert-butylbenzoic acid. Mixtures of these acids have proven to be particularly effective, in particular mixtures of undecanedioic acid and dodecanedioic acid, in a weight ratio of 3:1 to 1:3, and in particular 1:1.

A further object of the invention is a water-soluble concentrate for aqueous functional fluids, and in particular for HFA hydraulic fluids, that contains animal, vegetable, mineral, and/or synthetic oils, fats, or oil or fat components as lubricants, fatty alcohols, biocides, fungicides, complexing agents, heavy metal inhibitors, non-ionic or anionic emulsifiers, dispersing agents, anti-foaming agents, corrosion protectants, and water, and typical additives as a remainder, and as a significant component in accordance with the invention, 2 to 20 weight 6, preferably 5 to 15 weight %, of the corrosion protectant defined above, where the weigh percentage is relative to the weight of the water-soluble concentrate.

According to a preferred embodiment, the water-soluble concentrate contains 1 to 12 weight %, preferably 2 to 8 weight 6, of at least one fatty acid alkanolamide based on saturated or unsaturated fatty acids, with 10 to 20 carbon atoms, 1 to 8 weight % at least, preferably 1.5 to 5 weight % of an alcohol with 2 to 14 carbon atoms, and 1 to 8 weight %, preferably 1 to 5 weight % of an aromatic monocarboxylic acid or aliphatic dicarboxylic acid with 10 to 12 carbon atoms.

The water-soluble concentrate advantageously contains a fatty acid alkanolamide based on saturated or unsaturated fatty acids with 12 to 18 carbon atoms, and alkanolamines with 2 to 6 carbon atoms, where monoethanolamine, diethanolamine, triethanolamine, monopropanolamine, monoisopropanolamine, 2-amino-2-methyl-1-propanol, 2-amino-2-ethyl-1,3-propandiol, and diglycolamine are especially preferred as the alkanolamine. More preferably, the concentrate contains as the fatty acid alkanolamide a coconut acid monoalkanolamide and/or tall oil acid monoalkanolamide, in particular coconut acid monoethanolamide and/or tall oil acid monopropanolamide. According to a further preferred embodiment, a reaction product of coconut acid, coconut oil, tall oil acid, and/or tall oil and diglycolamine is used as the fatty acid alkanolamide.

The concentrate advantageously contains an aliphatic, aromatic, or aliphatic-aromatic mono or dialcohol with 3 to 10 carbon atoms as the alcohol, more preferably isopropanol, n-butanol, butyldiglycol, hexylene glycol, butyltriglycol, benzyl alcohol and phenoxyethanol, where these alcohols can be used individually or in the form of any desired mixture.

The water-soluble concentrate preferably contains, as the aromatic monocarboxylic acid or aliphatic dicarboxylic acid, sebacic acid, undecanedioic acid, dodecanedioic acid, or p-tert-butyl benzoic acid, where these acids can be used individually or in the form of mixtures. Mixtures of undecanedioic acid and dodecanedioic acid with weight ratios of 3:1 to 1:3, in particular 1:1, are especially preferred. These mixtures have been found to be particularly advantageous with regard to corrosion protection effects.

According to a further preferred embodiment, the water-soluble concentrate according to the invention can have 0.5 to 3 weight % of a biocidal compound that is selected from biocidal quaternary ammonium compounds, guanidine derivates, O or N-formals, O or N-acetals, isothiazolines, isothiazolinones, aliphatic amines or diamines, 3-iodine-2-propinyl-butyl carbamate, bis (3-aminopropyl)-dodecylamine and mixtures thereof. As a fungicide or bactericide, the concentrate can contain 0.5 to 3 weight % of a fungicidal pyridine derivate, preferably pyrithion or a pyrithion derivate such as 2-pyridinthiol-1-oxide sodium salt.

According to a further preferred embodiment, the water-soluble concentrate according to the invention can contain 0.5 to 3% of a biocidal compound that is selected from biocidal quaternary ammonium compounds, guanidine derivatives, O or N-formals, 0 or N-acetals, isothiazolines, isothiazolinones, aliphatic amines or diamines, 3-iodine-2-propinyl-butyl carbamate, bis (3-aminopropyl)-dodecylamine and mixtures of these. As a fungicide or bactericide, the concentrate can contain 0.5 to 3 weight % of a fungicidal pyridine derivative, preferably pyrithion or a pyrithion derivative such as 2-pyridinthiol-1-oxide sodium salt.

As a complexing agent, the concentrate according to the invention can contain 0.5 to 5 weight % of ethylenediaminetetraacetic acid or its alkali or ammonium salts, sodium citrate, sodium glucomate, N,N'-disalicylides, and/or derivates of them.

According to a further advantageous embodiment, the water-soluble concentrate according to the invention contains 1 to 8 weight %, preferably 2 to 5 weight % of an additional corrosion protectant selected from phosphoric acid esters, such as ethylhexylphosphoric acid, phosphonic acid derivatives, diamine oxethylate, triamine oxethylate, alkylimidazoline, polyaminenaphthalic acid amines, synthetic or natural sulfonates, such as petroleum sulfonates, p-tert-butyl benzoic acid, tricarboxylic acids, neodecanoic acids, 5 or 6-carboxy-4-hexyl-2-hexene-1-octane acid, saturated or unsaturated fatty acids, ethoxylated or propoxylated fatty acids and fatty acid alkanolamides, thiadiazole compounds, and mixtures of these.

Further, the water-soluble concentrate according to the invention may contain, as an additional corrosion protectant, 3 to 35 weight % of a reaction product from boric acid and primary or tertiary alkanolamines.

The concentrate according to the invention can further contain 0.05 to 1.5 weight % benzotriazol and/or toluyltriazol and/or derivatives thereof as a heavy metal inhibitor.

According to the invention, the water-soluble concentrate contains 3 to 70 weight 6 of a natural or synthetic mineral oil as an animal, vegetable, mineral, and/or synthetic lubricant; 2 to 40 weight % of an ester oil, which is a typical synthetic ester oil that is known to a person skilled in the art; 1 to 6 weight % of a phospated and/or ethyloxylated alcohol and/or 2 to 35 weight % of a polyalkylene glycol and/or polyvinylpyrrolidone, with the requirement that this lubricant makes up 10 to 70 weight % of the water-soluble concentrate.

As a defoamer, the concentrate can contain 0.05 to 1 weight % of a siloxane compound, while 1 to 5 weight % oleoylsarcoside is preferred as an emulsifier. The concentrate can contain 0.2 to 5 weight % of an acrylic polymer as a dispergent, in particular a salt of a poly(meth)acrylic acid.

According to a preferred embodiment, the water-soluble concentrate has a pH value of 8.4 to 9.8, preferably 9.0 to 9.5, after diluting with water to a concentration of 1 to 20 weight % relative to the functional fluid obtained.

According to a further embodiment, the invention relates to the use of the water-soluble concentrate described above to produce a lubricant, an abrasive, a hydraulic fluid, or a coolant/lubricant on an aqueous basis for metal forming and metal cutting, by mixing from 1 to 20 weight %, preferably 2 to 5 weight %, of the water-soluble concentrate described above with 99 to 80 weight %, preferably 99 to 95 weight % of water. Non-cutting metal forming, in the sense of use according to the invention, is considered to be deep drawing, cold forming, or rolling, while cutting metalworking includes the turning, milling, drilling, and grinding of metals.

It has been surprisingly determined that the water-soluble concentrate according to the invention, even when mixed with water with a hardness of 9° dH to 42° dH at a concentrate level of 2%, results in HFA hydraulic fluid in the form of emulsions that are absolutely stable, even after 600 hours at a temperature of 50° C.

The corrosion protectant according to the invention is produced by simple mixing of the components. The water-soluble concentrate of the present invention is produced in that the components that are soluble or dispersible in water are first added to the water, then the oil-soluble ingredients are dissolved or dispersed in the oil component, then the aqueous mixture is slowly added to the mineral oil mixture.

The following examples serve to further clarify the invention.

In the examples and the comparative examples, the corrosion protection effect that is obtained with the corrosion protectant according to the invention is determined using the crevice corrosion test in accordance with the DSK norm N 762 830. The corrosion test procedure using the crevice corrosion test is published in Glückauf 138 (2002) No. 5, pages 208-212. The procedure consists of keeping the pressure fluid or hydraulic fluid to be tested in a defined stamped unit (piston-cylinder) under purely static conditions for 21 days at a humidity of 95% and testing temperature of 35° C. The crevice area is formed between the inner surface of the cylinder and a bronze part on the piston. A typical sealing ring is placed on the bronze part. After a period of contact with the fluid under test for 21 days, the stamping unit is disassembled and the crevice area on the inner surface of the cylinder is examined for corrosion. This crevice corrosion test shows that if there is insufficient corrosion protection, in addition to pitting corrosion and crater formation, scale-like, very differently coloured corrosion products are deposited in the crevice area on the cylinder surface. If these deposits are located in the crevice area of the sealing ring on the cylinder surface, then they are typically also found on the sealing ring surface and the bronze surface. Small particles collect in particular on the sealing lip, which are responsible for a line of corrosion around the perimeter of the cylinder surface. With regard to the definition of the term "crevice corrosion", reference is made to the norm DIN EN ISO 8044-3.17.

EXAMPLES 1 THROUGH 5 AND COMPARATIVE EXAMPLES A THROUGH E

The components listed in the following tables 1 through 3 are first used to produce water-soluble concentrates, which are then mixed at a ratio of 2 weight parts of concentrate to 98 weight parts of water, to make an HFA hydraulic fluid, which is then tested using the crevice corrosion test indicated above.

To make the water-soluble concentrates, water is first presented, whereupon potassium hydroxide is added and dissolved by stirring. The acids used in each case, such as sebacic acid, dodecanedioic acid, undecanedioic acid, or in the comparative example E, neodecanoic acid, are added, and stirred at a temperature of 50° C. until the pH value of the mixture is 7. Sodium citrate and monoethanolamine are then added and the mixture is allowed to cool to 25° C. while stirring.

In a separate container, one part of the aliphatic hydrocarbon (50%) used as a lubricant is heated, then the fatty acid alkanolamide, sodium petrolsulfonate is added while stirring, and then the remaining aliphatic hydrocarbon, followed by the rest of the ingredients. It is then thoroughly mixed and the aqueous mixture obtained from the first stage is added to the aliphatic hydrocarbon mixture while stirring. The result is a light brown, clear, slightly viscous concentrate, which is then mixed with water to make the aqueous functional fluid (HFA hydraulic fluid) containing 2 weight % of the concentrate and 98 weight % of water. This HFA hydraulic fluid is placed in the crevice area of the stamping unit for the crevice corrosion test and stored statically for 21 days at a humidity of 95% and a temperature of 35° C. After opening the stamping unit, and removing the HFA fluid contained in it, the test fixture is examined for silting on the bottom of the outer tube, in the crevice area, and in the bronze piston area, and for deposits prior to cleaning in the interior tube and exterior tube, and for tarnishing after cleaning in the interior tube and exterior tube, and for solid deposits on the interior surface of the cylinder and in the crevice area of the cylinder, as well as on the surface of the bronze piston.

As indicated in the following tables 1 to 3, no corrosion effects are present with the HFA hydraulic fluids according to the present invention, while the products in the comparative examples A and B do not pass the corrosion test according to the DSK norm N 762 830, since deposits can be found on the cylinder prior to cleaning, and solid deposits in the crevice area of the cylinder, and a line of corrosion around the perimeter in the crevice area of the cylinder.

TABLE 1

| Components | Example 1 Wt % | Comparison A Wt % | Example 2 Wt % | Comparison B Wt % |
|---|---|---|---|---|
| Water | 28.0 | 31.6 | 28.0 | 32.0 |
| Toluyltriazol/ Benzotriazol | 0.5 | 0.5 | 0.5 | 0.5 |
| Fatty alcohol polyglycol ether | 3.6 | 3.6 | 3.6 | 3.6 |
| Oleoylsarcoside | 1.8 | 1.8 | 1.8 | 1.8 |
| Hexahydrotriazine | 1.2 | 1.2 | 1.2 | 1.2 |
| Aliphatic hydrocarbon, boiling range <200° C. (BNS 4) | 42.8 | 42.8 | 42.8 | 42.8 |
| Synthetic sodium petrolsulfonate | 1.8 | 1.8 | 1.8 | 1.8 |
| Potassium hydroxide | 1.3 | 1.3 | 1.3 | |
| Sodium citrate | 0.9 | 0.9 | 0.9 | 0.9 |
| Triethanolamine, pure | | | | |
| Oleylether carboxylic acid 5 EO | 1.8 | 1.8 | 1.8 | 1.8 |
| 5-,6-Carboxy-4-hexyl-2-cyclohexene-1-octane acid | | | | |
| Polysiloxane defoamer | 0.25 | 0.25 | 0.25 | 0.25 |
| Monoethanolamine | 2.6 | 2.6 | 2.6 | 2.6 |
| Tall oil fatty acid | | | | |
| 2-Ethylhexylphosphoric acid | | | | |
| 3-Iodine-2-propinylbutylcarbamate | 0.35 | 0.35 | 0.35 | 0.35 |
| Bis(3-aminopropyl)-dodecylamine | 0.5 | 0.5 | 0.5 | 0.5 |
| Coconut acid alkanolamide | | | 3.0 | 3.0 |
| Tall oil fatty acid alkanolamide | 6.3 | 6.3 | 3.3 | 3.3 |

TABLE 1-continued

| Components | Example 1 Wt % | Comparison A Wt % | Example 2 Wt % | Comparison B Wt % |
|---|---|---|---|---|
| n-Butanol | 0.9 | | 0.9 | 0.9 |
| Benzyl alcohol | 2.7 | | 2.7 | 2.7 |
| Butyl diglycol | | | | |
| Sebacic acid | | | | |
| Dodecanedioic acid | 1.35 | 1.35 | 1.35 | |
| Undecanedioic acid | 1.35 | 1.35 | 1.35 | |
| Neodecanoic acid ($C_{10}$ Monocarboxylic acid | | | | |
| Total | 100.00 | 100.00 | 100.00 | 100.00 |
| pH value after dilution | 9.3 | 8.8 | 9.2 | 9.4 |
| Crevice corrosion test per DSK N 762 830 | No corrosion | Deposits in cylinder, solid deposits, line corrosion | No corrosion | Deposits in cylinder, solid deposits, line corrosion |

TABLE 2

| Components | Example 3 Wt % | Comparison C Wt % | Example 4 Wt % | Comparison D Wt % |
|---|---|---|---|---|
| Water | 25.7 | 30.1 | 59.0 | 62.5 |
| Toluyltriazol/ Benzotriazol | 0.2 | 0.2 | 0.2 | 0.2 |
| Fatty alcohol polyglycol ether | 3.6 | 3.6 | 3.0 | 3.0 |
| Oleoylsarcoside | 1.8 | 1.8 | 1.0 | 1.0 |
| Hexahydrotriazine | 0.5 | 0.5 | 1.0 | 1.0 |
| Aliphatic hydrocarbon, boiling range <200° C. (BNS 4) | 42.8 | 42.8 | 13.0 | 13.0 |
| Synthetic sodium petrolsulfonate | 1.8 | 1.8 | 1.0 | 1.0 |
| Potassium hydroxide | 1.0 | 1.0 | 1.0 | 1.0 |
| Sodium citrate | 0.9 | 0.9 | 1.0 | 1.0 |
| Triethanolamine, pure | | | | |
| Oleylether carboxylic acid 5 EO | 1.8 | 1.8 | 2.0 | 2.0 |
| 5-,6-Carboxyl-4-hexyl-2-cyclohexene-1-octane acid | 0.75 | 0.75 | | |
| Polysiloxane defoamer | 0.25 | 0.25 | 0.5 | 0.5 |
| Monoethanolamine | 4.3 | 4.3 | 3.8 | 3.8 |
| Tall oil fatty acid | 0.8 | 0.8 | | |
| 2-Ethylhexylphosphoric acid | 2.0 | 2.0 | 3.0 | 3.0 |
| 3-Iodine-2-propinylbutylcarbamate | | | | |
| Bis(3-aminopropyl)-dodecylamine | 0.5 | 0.5 | | |
| Coconut acid alkanolamide | 5.0 | 5.0 | 5.0 | 5.0 |
| Tall oil fatty acid alkanolamide | | | | |
| n-Butanol | 0.9 | | 1.0 | |
| Benzyl alcohol | 2.5 | | 2.5 | |
| Butyl diglycol | 1.0 | | | |
| Sebacic acid | 1.0 | 1.0 | | |

TABLE 2-continued

| Components | Example 3 Wt % | Comparison C Wt % | Example 4 Wt % | Comparison D Wt % |
|---|---|---|---|---|
| Dodecanedioic acid | | | 1.0 | 1.0 |
| Undecanedioic acid | 1.0 | 1.0 | 1.0 | 1.0 |
| Neodecanoic acid ($C_{10}$ Monocarboxylic acid | | | | |
| Total | 100.00 | 100.00 | 100.0 | 100.0 |
| pH value after dilution | 9.40 | 9.40 | 9.2 | 8.6 |
| Crevice corrosion test per DSK N 762 830 | No corrosion | Deposits in cylinder, solid deposits, line corrosion | No corrosion | Deposits in cylinder, solid deposits, line corrosion |

TABLE 3

| Components | Example 5 Wt % | Comparison E Wt % |
|---|---|---|
| Water | 61.5 | 61.5 |
| Toluyltriazol/Benzotriazol | 0.2 | 0.2 |
| Fatty alcohol polyglycol ether | 3.0 | 3.0 |
| Oleoylsarcoside | 1.0 | 1.0 |
| Hexahydrotriazine | 1.0 | 1.0 |
| Aliphatic hydrocarbon, boiling range <200° C. (BNS 4) | 13.0 | 13.0 |
| Synthetic sodium petrolsulfonate | 1.0 | 1.0 |
| Potassium hydroxide | 1.0 | 1.0 |
| Sodium citrate | 1.0 | 1.0 |
| Triethanolamine, pure | 2.0 | 2.0 |
| Oleylether carboxylic acid 5 EO | 2.0 | 2.0 |
| 5-,6-Carboxy-4-hexyl-2-cyclohexene-1-octane acid | | |
| Polysiloxane defoamer | 0.5 | 0.5 |
| Monoethanolamine | 0.3 | 0.3 |
| Tall oil fatty acid | | |
| 2-Ethylhexylphosphoric acid | | |
| 3-Iodine-2-propinylbutylcarbamate | | |
| Bis(3-aminopropyl)-dodecylamine | | |
| Coconut acid alkanolamide | 5.0 | 5.0 |
| Tall oil fatty acid alkanolamide | | |
| n-Butanol | 1.0 | 1.0 |
| Benzyl alcohol | 1.5 | 1.5 |
| Butyl diglycol | 3.0 | 3.0 |
| Sebacic acid | | |
| Dodecanedioic acid | 1.0 | |
| Undecanedioic acid | 1.0 | |
| Neodecanoic acid ($C_{10}$ Monocarboxylic acid | | 2.0 |
| Total | 100.00 | 100.00 |
| pH value after dilution | 8.9 | 9.0 |
| Crevice corrosion test per DSK N 762 830 | No corrosion | Deposits in cylinder, solid deposits, line corrosion |

The comparative example E in particular shows that an aqueous hydraulic fluid that contains Neododecanoic acid, that is a $C_{10}$-monocarboxylic acid, causes significant corrosion effects and is therefore unsuitable for use as an HFA hydraulic fluid, while the corrosion protectant according to the invention and the HFA hydraulic fluid that contains it, which differs from the state of the art product in the selection, according to the invention, of the special aliphatic dicarboxylic acids, shows no corrosion effects and is immediately suitable for use, for example, in hydraulic face support systems for mining.

This result of a leap in improvement in the corrosion protection effect from the combination according to the invention of the defined fatty acid alkanolamide, the defined alcohol, and the defined aromatic monocarboxylic acid or defined aliphatic dicarboxylic acids is surprising and was in no way to be expected.

The invention claimed is:

1. A water-soluble concentrate for aqueous functional fluids containing a lubricant selected from the group consisting of animal oil, vegetable oil, mineral oil, and/of synthetic oils, fats, oil components and fat components; fatty alcohols; biocides; fungicides; complexing agents; heavy metal inhibitors; non-ionic or anionic emulsifiers; dispersants; anti-foaming agents; corrosion protectant; and water; characterized in that it contains as the corrosion protectant 2 to 20 weight relative to the weight of the concentrate of a corrosion protectant comprising 5 to 80 weight % of at least one fatty acid alkanolamide based on saturated or unsaturated fatty acids with 10 to 20 carbon atoms, 5 to 80 weight % of at least one alcohol with 2 to 14 carbon atoms selected from the group consisting of isopropanol, n-butanol, butyl diglycol, hexylene glycol, butyl triglycol, and phenoxyethanol, and 5 to 80 weight % of at least one aromatic monocarboxylic acid or aliphatic dicarboxylic acid with 10 to 12 carbon atoms selected from the group consisting of sebacic acid, undecanedioic acid, dodecanedioic acid, and p-tert-butylbenzoic acid, where the sum of these components is 100 weight %, and the weight % is relative to the weight of the corrosion protectant.

2. The concentrate as claimed in claim 1, characterized in that it contains 1 to 12 weight % of at least one fatty acid alkanolamide based on saturated or unsaturated fatty acids with 10 to 20 carbon atoms, 1 to 8 weight % of said at least one alcohol with 2 to 14 carbon atoms, and 1 to 8 weight % of said at least one aromatic monocarboxylic acid or aliphatic dicarboxylic acid with 10 to 12 carbon atoms.

3. The concentrate as claimed in claim 2, characterized in that it contains 2 to 8 weight % of at least one fatty acid alkanolamide, 1.5 to 5 weight % of said at least one alcohol, and 1 to 5 weight % of said at least one aromatic monocarboxylic acid or aliphatic dicarboxylic acid.

4. The concentrate as claimed in claim 1, characterized in that it contains fatty acid alkanolamides based on saturated or unsaturated fatty acids with 12 to 18 carbon atoms and alkanolamines with 2 to 6 carbon atoms.

5. The concentrate as claimed in claim 4, characterized in that it contains fatty acid alkanolamides based on saturated or unsaturated fatty acids with 12 to carbon atoms and monoethanolamine, diethanolamine, triethanolamine, monopropanolamine, monoisopropanolamine, 2-amino-2-methyl-1-propanol, 2-amino-2-ethyl-1,3-propandiol and/or diglycolamine.

6. The concentrate as claimed in claim 4, characterized in that it contains coconut acid monoalkanolamide and/or tall oil acid monoalkanolamide as the fatty acid alkanolamide.

7. The concentrate as claimed in claim 6, characterized in that it contains a reaction product of coconut acid, coconut oil, tall oil fatty acid, and/or tall oil and diglycolamine as the fatty acid alkanolamide.

8. The concentrate as claimed in claim 6, characterized in that it contains coconut acid monoethanolamide, coconut acid monopropanolamide, tall oil fatty acid monoethanolamide and/or tall oil acid monopropanolamide as the fatty acid alkanolamide.

9. The concentrate as claimed in claim 1, characterized in that it contains 0.5 to 3 weight % of a biocidal compound that is selected from biocidal quaternary ammonium compounds, guanidine derivates, O or N-formals, O or N-acetals, isothiazolines, isothiazolinones, aliphatic amines or diamines, 3-iodine-2-propinyl-butyl carbamate, bis(3-aminopropyl)-dodecylamine and mixtures thereof.

10. The concentrate as claimed in claim 1, characterized in that it contains 0.5 to 3 weight % of a fungicidal pyridine derivate as a fungicide or bactericide.

11. The concentrate as claimed in claim 1, characterized in that it contains 0.5 to 5 weight % of ethylenediaminetetraacetic acid or its alkali or ammonium salts, sodium citrate, sodium qluconate, N,N'-disalicylides, and/or derivates of them as a complexing agent.

12. The concentrate as claimed in claim 1, characterized in that it contains 1 to 8 weight % of an additional corrosion protectant selected from the group consisting of phosphoric acid esters, synthetic or natural sulfonates and mixtures of these.

13. The concentrate as claimed in claim 1, characterized in that it contains 3 to 25 weight % of a reaction product from boric acid and primary or tertiary alkanolamines as an additional corrosion protectant.

14. The concentrate as claimed in claim 1, characterized in that it contains 0.05 to 1.5 weight % benzotriazol and/or toluoyltriazol and/or derivatives thereof as a heavy metal inhibitor.

15. The concentrate as claimed in claim 1, characterized in that it contains 3 to 70 weight % of a natural or synthetic mineral oil; 2 to 40 weight % of an ester oil; 1 to 6 weight % of a phospated and/or ethyloxylated alcohol and/or 2 to 35 weight % of a polyalkylene glycol and/or polyvinylpyrrolidone as an animal, vegetable, mineral, and/or synthetic lubricant, with the requirement that this lubricant makes up 10 to 70 weight % of the concentrate.

16. The concentrate as claimed in claim 1, characterized in that it contains 0.05 to 1 weight % of a siloxane compound as a defoamer.

17. The concentrate as claimed in claim 1, characterized in that it contains 1 to 5 weight % oleoylsarcoside and/or ethoxylated oleylethercarboxylic acid as an emulsifier.

18. The concentrate as claimed in claim 1, characterized in that it contains 0.2 to 5 weight % of an acrylic polymer as a dispersant.

19. The concentrate as claimed in claim 1, characterized in that it has a pH value of 8.4 to 9.8, after diluting with water to a concentration of 1 to 20 weight % relative to the functional fluid obtained.

20. A method of metal forming and metal cutting comprising producing on an aqueous basis a member selected from the group consisting of a lubricant, an abrasive, a hydraulic fluid, and a coolant/lubricant by mixing from 1 to 20 weight % with 99 to 80 weight % of water with the water-soluble concentrate as claimed in claim 11.

21. The concentrate as claimed in claim 1, characterized in that the corrosion protectant is present in an amount of 5 to 15 weight %.

22. The concentrate as claimed in claim 10, characterized in that the fungicidal pyridine derivate is pyrithion or pyrition derivate.

23. The concentrate as claimed in claim 22, characterized in that the pyrithion derivate is 2-pyridinthiol-1-oxide sodium salt.

24. The concentrate as claimed in claim 12, characterized in that it contains 2 to 5 weight % of said additional corrosion protectant.

25. The concentrate as claimed in claim 12, characterized in that the phosphoric acid esters are selected from the group consisting of ethylhexylphosphoric acid, phosphonic acid derivatives, diamine oxethylate, triamine oxethylate, alkylimidazoline, polyaminenaphthalic acid amines, and mixtures thereof.

26. The concentrate as claimed in claim 12, characterized in that the synthetic or natural sulfonates are selected from the group consisting of petroleum sulfonates, p-tert-butyl benzoic acid, tricarboxylic acids, neodecanoic acids, 5 or 6-carboxy-4-hexyl-2-hexene-1-octane acid, saturated or unsaturated fatty acids, ethoxylated or propoxylated fatty acids, fatty acid alkanolamides, thiadiazole compounds, and mixtures thereof.

27. The concentrate as claimed in claim 18, characterized in that the dispersant is a salt of a poly(meth)acrylic acid.

28. The concentrate as claimed in claim 19, characterized in that it has a pH value of 9.0 to 9.5.

* * * * *

UNITED STATES PATENT AND TRADEMARK OFFICE

CERTIFICATE OF CORRECTION

PATENT NO. : 7,851,420 B2
APPLICATION NO. : 11/665160
DATED : December 14, 2010
INVENTOR(S) : Helmut Theunissen and Sabine Theunissen It is certified that error appears in the above-identified patent and that said Letters Patent is hereby corrected as shown below:

Claim 1, Column 9, Line 19,
Please delete "mineral oil, and/of synthetic oils," and replace with -- mineral oil, synthetic oils, --

Claim 1, Column 9, Line 24,
Please delete "weight relative" and replace with -- weight % relative --

Claim 5, Column 9, Line 56,
Please delete "12 to carbon atoms" and replace with --12 to 18 carbon atoms --

Claim 11, Column 10, Line 19,
Please delete "sodium qluconate," and replace with -- sodium gluconate, --

Claim 14, Column 10, Line 32,
Please delete "toluoyltriazol and/or" and replace with -- toluyltriazol and/or --

Claim 20, Column 10, Line 61,
Please delete "claim 11." and replace with -- claim 1. --

Signed and Sealed this
First Day of February, 2011

David J. Kappos

David J. Kappos
*Director of the United States Patent and Trademark Office*